313-422 SR
7/19/83 OR 4,394,599

United States Patent [19]
Smith et al.

[11] 4,394,599
[45] Jul. 19, 1983

[54] FLAT CATHODE RAY TUBE

[75] Inventors: James Smith, Reigate; Daphne L. Lamport, Caterham, both of England

[73] Assignee: U.S. Philips Corporation, New York, N.Y.

[21] Appl. No.: 241,269

[22] Filed: Mar. 6, 1981

[51] Int. Cl.[3] ..... H01J 29/46
[52] U.S. Cl. ..... 313/422; 313/423; 313/426
[58] Field of Search ..... 313/422, 423, 426; 328/256

[56] References Cited

U.S. PATENT DOCUMENTS

| | | | |
|---|---|---|---|
| 2,850,669 | 9/1958 | Geer | 313/422 X |
| 2,926,255 | 2/1960 | Gabor et al. | 313/422 X |
| 2,999,957 | 9/1961 | Schagen et al. | 313/422 |
| 3,990,038 | 11/1976 | Jensen et al. | 313/423 X |

*Primary Examiner*—Eugene R. LaRoche
*Attorney, Agent, or Firm*—Robert J. Kraus

[57] ABSTRACT

A flat cathode ray tube comprises in an envelope (10) an electron gun (16) for generating a low energy electron beam (14) which undergoes electrostatic frame deflection by means of a pair of electrodes (22, 24). The electron beam (14) then has its energy increased by means of a double electron lens (30). The double electron lens (30) comprises a first electron lens (32) the image of which forms the object for a second electron lens (36) which provides an electron spot of acceptable size on the screen (12). Thereafter the beam undergoes line deflection in an electrostatic line deflector (40). The line deflector (40) varies the angle of entry of the electron beam into a uniform electric field formed between the screen (12) and a repeller electrode (44) where electron beam follows a parabolic trajectory to the screen (12).

8 Claims, 5 Drawing Figures

FLAT CATHODE RAY TUBE

BACKGROUND OF THE INVENTION

The invention relates to a flat cathode ray tube comprising an electron gun to generate a low energy electron beam, first means to deflect the low energy beam in a first direction, means to accelerate the beam deflected in the first direction to a high energy beam, second means to deflect the high energy beam in a second direction and a trajectory control space which is formed by a screen and a repeller electrode provided at some distance from the screen.

The invention relates in particular to a low power flat cathode ray tube having a screen whose diagonal is typically 12.5 cm. By a flat cathode ray tube is meant one in which either the electron gun is disposed laterally of the screen and for convenience will be described as a single plane flat tube or the electron gun is disposed behind the screen so that the electron beam is bent through 180° before it is deflected towards the screen.

Such a flat cathode ray tube is known from British Pat. No. 865,667 (PHB 30735) corresponding to U.S. Pat. No. 2,999,957. This patent describes embodiments of flat cathode ray tubes of various dimensions (for example, screen diagonal 50 cm), in which an electron beam is generated by an electron gun whose axis is inclined or parallel relative to the plane of the fluorescent screen. FIG. 14 of the above-mentioned patent corresponding to FIG. 27 of the '957 patent, shows an embodiment of a single plane cathode ray tube having an electron gun whose axis is at an acute angle to the edge of a trajectory control space formed between a phosphor screen and a repeller electrode. The electron beam leaving the gun is bent through said acute angle when being deflected in a first horizonal direction, is accelerated, and is deflected in a second, vertical direction as it enters the trajectory control space. The means for horizontally deflecting the electron beam comprises a slotted electrode and a parallel repeller electrode to define an auxiliary trajectory control space, the electrodes being inclined relative to the axis of the electron gun and the edge of the first mentioned trajectory control space. By maintaining a potential difference between these electrodes the beam from the electron gun passes into the auxiliary trajectory control space and follows a parabolic trajectory to pass through the slotted electrode along a path substantially normal to the edge of the first mentioned trajectory control space. Line deflection is achieved by holding the potential of the slotted electrode constant at 5 KV and varying the potential of the repeller electrode between 1.2 and 4.3 KV at line frequency, all the voltages being measured with respect to a 0 volt potential at the cathode, of the electron gun. After passing through the slotted electrode the beam is accelerated by another slotted electrode parallel to the first mentioned one and held at a potential of 15 KV. The accelerated electron beam passes through a triangular field free space, and then passes between a pair of frame deflecting electrodes which varies the angle of entry of the electron beam into the first mentioned trajectory control space in which the beam follows a parabolic trajectory to then impinge on the phosphor screen. Typically the phosphor screen is at a constant potential of 15 KV whilst that of its associated repeller electrode is at a lower voltage.

The above described cathode ray tube of British Pat. No. 865,667 is essentially a high voltage tube and can be used in situations where power consumption is not of vital importance. A high energy beam is produced by the electron gun and, in order to bend the beam through said acute angle whilst at the same time swing the voltage between 1.2 and 4.3 KV, a reliable high voltage driver is required which is expensive. Since the known cathode ray tube is of a relatively large size it is possible to accelerate the electron beam over a relatively large space, say 10 KV over 7.5 to 10 cms, without adversely affecting the spot size.

SUMMARY OF THE INVENTION

It is an object of the present invention to provide a small flat cathode ray tube having a lower power consumption and good resolution.

For that purpose, a flat cathode ray tube of a kind mentioned in the opening paragraph is characterized in that the means to accelerate the beam comprise a first and a second electron lens, which first electron lens accelerates the beam and converges it to form the object for the second electron lens which also accelerates and converges the beam.

The invention is based on the following recognition. In the cathode ray tube in accordance with the present invention, the electron beam from the electron gun initially undergoes for example, frame deflection and has an energy, for example, of 263 eV. Hence the necessary driver can be economical on power. As the next deflection, in this embodiment the line deflection, is best done at a potential approaching the screen potential of 5 KV then it is necessary to increase the beam energy over as short a distance as possible in order to keep the tube size to the minimum but at the same time maintain an acceptable screen spot size. A simple accelerating electrode of the type disclosed in British Pat. No. 865,667 would produce a high field which would lead to strong convergence and an unacceptably large screen spot size. By providing a double electron lens then it has proved possible to meet the requirements of maintaining the tube size to the minimum, increasing the energy of the beam and maintaining the screen spot size acceptable. The double lens comprises a first and second electron lens, each of which increases the beam energy by a certain factor for example, by four. In operation the first electron lens produces an image which acts as an object for the second electron lens.

An embodiment of a flat cathode ray tube is characterized in that the first and second electron lens are each formed by a first and second electrode having a slotted aperture.

To save space, according to a further embodiment the second electrode of the first electron lens and the first electrode of the second electron lens may form a common electrode.

Furthermore, the second electrode of the second electron lens may form part of the means to deflect the high energy beam in a second direction. The varying voltage which is applied to the means for deflecting in a second direction, however, may not disturb the second electron lens too much. In this latter case the second electrode of the second electron lens should be constructed as a separate electrode.

In a further embodiment the first electrode of the first electron lens forms part of the means to deflect the low energy beam in a first direction so that space is also saved.

If the longitudinal axis of the electron gun is inclined relative to the trajectory of the electron beam which penetrates into the first electron lens an embodiment is characterized in that between the means to deflect the beam in a first direction and the first electron lens a field-free box is provided and the first electrode of the first electron lens forms part of the field-free box. In a flat cathode ray tube in which the means to deflect the beam in a first direction comprise a repeller electrode and a first electrode having a slotted aperture, further space may be saved by causing the electrode having the slotted aperture to form part of the field-free box.

If desired, at least one intermediate slotted electrode may be provided between the first slotted electrode and the repeller electrode, which intermediate electrode during operating of the tube conveys such a potential that a uniform field prevails between the first slotted electrode and the repeller electrode. By establishing such a uniform field between the front and back surfaces of the envelope, edge effects as well as charging of the envelope which may distort the beam are reduced.

BRIEF DESCRIPTION OF THE DRAWING

An embodiment of the present invention will now be described by way of example, with reference to the accompanying drawing, wherein.

DESCRIPTION OF THE PREFERRED EMBODIMENTS

Figure 1:
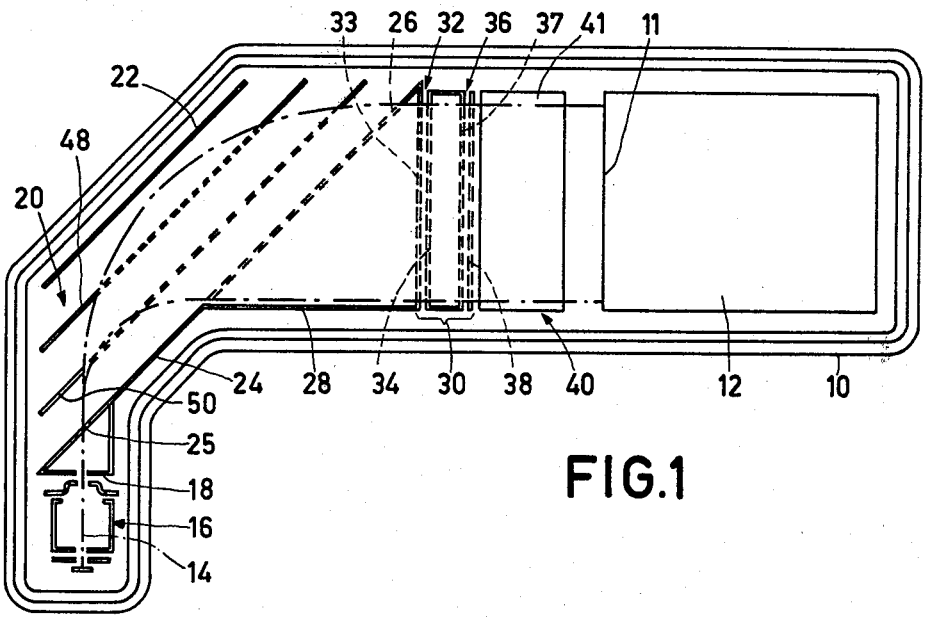
FIG. 1 is a front view of an embodiment of a cathode ray tube made in accordance with the present invention.
Figure 2:
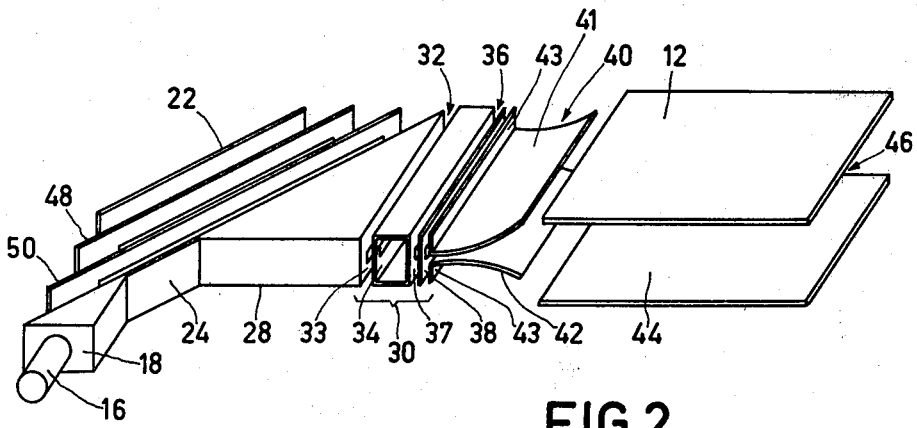
FIG. 2 is a perspective view of the cathode ray tube shown in FIG. 1 with its envelope removed.

Referring to FIGS. 1 and 2, the flat cathode ray tube comprises an evacuated envelope 10 which may be in the form of a dished portion closed by a flat glass plate on which a screen 12 is provided. Within the evelope 10, an electron beam 14 is produced by an electron gun 16 whose longitudinal axis is parallel to an edge 11 of the screen 12. After leaving a final anode 18 of the electron gun 16, the electron beam 14 is bent through 90° and at the same time undergoes frame deflection. These operations are carried out in an auxiliary trajectory control space 20 formed between a repeller electrode 22 and a parallel arranged slotted electrode 24 having an aperture 25 by which the electron beam 14 enters the auxiliary trajectory control space 20 and an elongate slot 26 by which the deflected beam leaves the space 20 and proceeds towards the screen 12 substantially normal to the edge 11. As will be understood from British Pat. No. 865,667 the electron beam 14 will follow a parabolic trajectory through the space 20 provided that the potential applied to the electrode 22 is lower than that applied to the electrode 24. Additionally the acute angles formed by the electron beam 14 with the electrode 24 when entering and leaving the space 20 are equal and therefore in the illustrated embodiment the electrodes 22 and 24 are inclined at 45° to the longitudinal axis 14 of the electron gun 15. Frame scanning is achieved by swinging the voltage applied to electrode 22 at field frequency, whilst holding the voltage at electrode 24 constant. In so doing the trajectory of the electron beam 14 can be altered so that it sweeps the length of the slot 26, the smaller the potential difference between the electrodes 22, 24 the longer the trajectory. The deflected beam then passes through a triangular shaped field free box 28 which is at the same potential as the slotted electrode 24 which in turn is at the same potential as the final anode 18 of the electron gun 14, consequently it is convenient to fabricate the anode 18, the electrode 24 and the box 28 as a one piece structure. Up to this point in the electron beam path, the electron beam has a low energy namely that determined by the final anode 18. In order to achieve satisfactory electrostatic line deflection of the electron beam 14 and a focused beam condition at the screen 12 it has been found that this is best done at a potential approaching that of the screen 12. Accordingly it is necessary to increase the energy of the beam over a short distance whilst ensuring that the beam spot on the screen is not unacceptably large.

Figure 3:
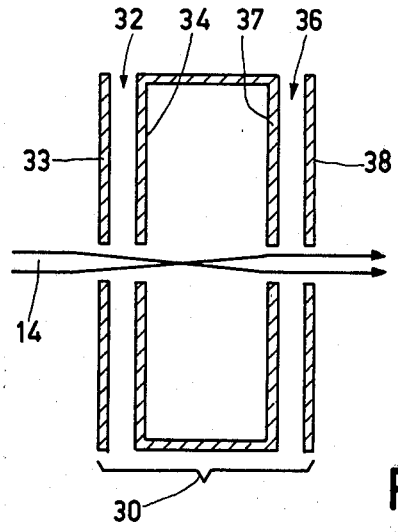
FIG. 3 is a diagrammatic cross sectional view of a double electron lens used in the embodiment shown in FIGS. 1 and 2.

In the illustrated embodiment the energy of the electron beam 14 is increased by means of a double electron lens 30 which comprises a first electron lens 32 formed by first and second slotted electrodes 33, 34. In the interests of compactness the electrode 33 forms a part of the field free box 28. The double electron lens 30 further comprises a second electron lens 36 formed by first and second slotted electrodes 37, 38. As the second electrode 34 of the first lens 32 and the first electrode 37 of the second lens 36 are at the same potential it is convenient and more compact to combine them into a box-like structure having slots in the opposite upstanding walls. Although the operation of the cathode ray tube will be described later it is sufficient at this point to say that the first electron lens 32 causes the electron beam 14 to converge so that its image forms the object of the second electron lens 36 which also converges the beam 14. This double convergence is illustrated in FIG. 3, the distance between the centres of each lens being of the order of 9.5 mm.

The electron beam 14 leaving the second electron lens 36 undergoes line deflection by a line deflector 40 formed by two spaced apart electrodes 41, 42 which diverge in a direction towards the display region of the tube. If desired upstanding wall portions 43 may be provided on the edges of the electrodes 41, 42 adjacent the electrode 38. In operation a varying potential difference is maintained between the electrodes 41, 42 so that the angle of entry of the electron beam 14 into the display region of the tube is varied. This display region is bounded by the screen 12 and a spaced apart, parallel arranged repeller electrode 44 which define between them a trajectory control space 46. A substantially constant potential difference is maintained between the screen 12 and the repeller electrode 44. Consequently by changing the angle of entry of the electron beam 14 into the trajectory control space 46 at line frequency, line scanning of the screen 12 will be produced.

In the illustrated embodiment the following voltages were applied to the electrodes, these voltages being related to that of the cathode of the electron gun 16 which is at 0 V:

Final anode 18, electrode 24, field free box 28 and electrode 33—fixed voltage of 263 V Repeller electrode 22—voltage varied between 114 V (top of screen 12 as shown in FIG. 1) and −109 V (bottom) at field frequency.
Electrodes 34 and 37—fixed voltage of 1050 V
Electrode 38—fixed voltage of 4200 V
Line deflector 40—mean voltage 4200 V
Electrode 41—voltage varied at line frequency between 4450 V (lefthand side of screen as viewed in FIGS. 1 and 2) and 4100 V (right hand side)
Electrode 42—voltage varied at line frequency between 3950 V (left hand side of screen) and 4300 V (right hand side)
Screen 12—fixed voltage 5000 V
Repeller electrode 44—fixed voltage 3400 V.

Figure 4:
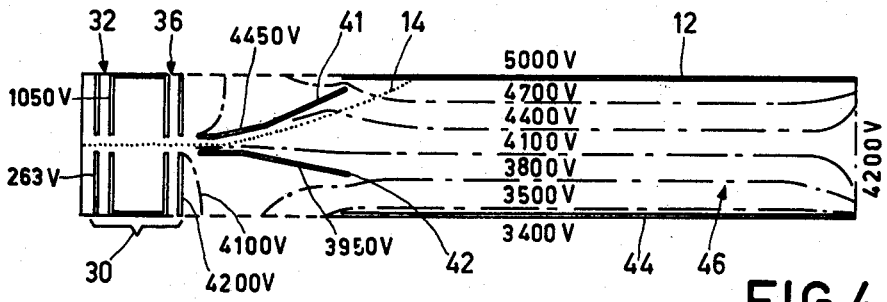
FIG. 4 shows in broken lines the equipotential lines for the double electron lens and the line scan regions of the cathode ray tube and in dotted lines the electron beam path for the shortest trajectory.
Figure 5:
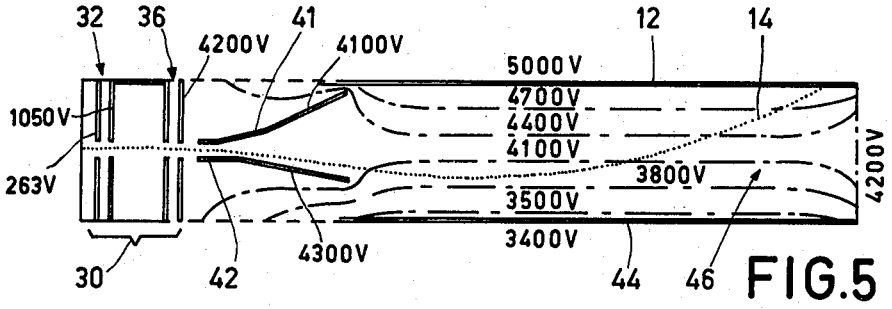
FIG. 5 shows a diagram corresponding to FIG. 4 but for the longest trajectory.

From the foregoing figures it can be concluded that the voltage ratio of each of the first and second electron lenses 32, 36 is X4 so that their powers are equal. FIG. 4 illustrates diagrammatically the double electron lens 30, the line deflector 40, the screen 12, the repeller electrode 44 and the trajectory control space 46 for the case where the electron beam trajectory on to the screen 12 is at a minimum. The equi-potential lines between the repeller electrode 44 and the screen 12 have been identified by the potential of the line. The electrodes 41 and 42 are at their maximum and minimum voltages, respectively, so that the angle of entry of the electron beam 14 into the trajectory control space is at a maximum and the electron beam impinges on to the screen 12 adjacent its left hand edge 11 (FIG. 1). FIG. 5 illustrates the case where the voltages applied to the electrodes 41 and 42 are at their minimum and maximum, respectively, and the potential of the electrode 42 is greater than that of the electrode 41. Consequently the electron beam 14 is deflected away from the screen 12 as it enters the trajectory control space 46 and is subsequently bent towards the screen 14 under the influence of the electric field in the space 46 and impinges on the screen 14 adjacent the right hand edge thereof. By varying the potentials applied to the electrodes 41, 42 at line frequency the electron beam 14 line scans the screen 12. A raster scan is produced by synchronizing the frame and line scanning as is done in a conventional television receiver.

Various modifications and alterations may be made to the structure and operation of the illustrated embodiment of the cathode ray tube.

The electrodes 22, 24 may for example be used for line scanning and the electrodes 41, 42 for frame scanning. However one effect of this is that the screen 12 would have to be rearranged so that its longer dimension is vertical, as viewed in FIG. 1, rather than horizontal. Also the tube would have to be positioned generally vertically, rather than generally horizontally, for correct viewing.

Additional slotted electrodes 48, 50 can be disposed in the auxiliary trajectory control space 20 between the electrodes 22, 24. The potentials applied to the electrodes 48, 50 are such that a uniform electric field is created by equi-spaced electrodes 22, 48, 50 and 24. An advantage of providing the additional electrodes is that the uniform electric field avoids the risk of edge effects being produced which would lead to charging of the envelope 10 and possible distortion of the electron beam 14. When these electrodes are being used for frame deflection, the potentials applied to the electrode 48, 50 vary in proportion to the potential applied to the repeller electrode 22, all potentials being relative to that applied to the electrode 24.

In the case of the double electron lens 30 modifications may include omitting the electrode 38 and using the upstanding walls 43 of the line deflector 40 as the second electrode of the second electron lens 36, the mean voltage applied to the walls 43 being 4200 V. Although this modification will save space, there is a danger of an asymmetrical field distribution being produced in the second electron lens 36 due to the swing in the deflection voltages applied to the electrodes 41, 42.

If desired the electrodes 33 of the first electron lens 32 may be separated from the field free box 28 to prevent the risk of field penetration into the field free space of the box 28. However the provision of an extra electrode will take up additional space.

Another, non-illustrated, embodiment of the present invention comprises a flat cathode ray tube in which the electron gun is disposed behind the screen and the beam therefrom has to be bent through 180° before being accelerated and line deflected by varying its angle of entry into the trajectory control space between a repeller electrode and the screen in the manner as described with reference to FIGS. 4 and 5. Frame deflection of the electron beam takes place prior to the electron beam being bent through 180°.

The embodiments described so far are monochrome cathode ray tubes. However, they may be adapted for colour by disposing a mesh electrode adjacent to, but spaced from, the screen which has parallel bands of phosphors applied thereto. The mesh electrode comprises a plurality of substantially parallel conductors which are spaced apart by a distance corresponding to the width of a band of phosphor lines. The mesh electrode is held at a fixed potential so that a trajectory control space is defined between the repeller and mesh electrodes. A variable potential difference is provided between the screen and the mesh electrode so that the electron beam passing through the mesh electrode is deflected and focused on to a phosphor line. For further information concerning this form of colour selection reference is made to British patent application No. 7,932,745 (PHB 32674).

What is claimed is:

1. A flat cathode ray tube including an electron gun for producing an electron beam, first means for deflecting the beam in a first direction, means for accelerating the deflected beam, second means for deflecting the accelerated beam in a second direction, and a pair of spaced-apart electrodes defining a trajectory control space into which the beam is directed by the second means, said electrodes including a screen and a repeller electrode for repelling the beam toward the screen, characterized in that the accelerating means comprises successively-arranged first and second lenses, each of said lenses accelerating and converging the beam, said first lens converging the beam to form an object for the second lens.

2. A flat cathode ray tube as claimed in claim 1, characterized in that the first and second electron lenses are each formed by first and second slotted electrodes.

3. A flat cathode ray tube as claimed in claim 2, characterized in that the second electrode of the first electron lens and the first electrode of the second electron lens comprises a common electrode.

4. A flat cathode ray tube as claimed in claim 2 or 3, characterized in that the second electrode of the second electron lens forms part of the means for deflecting the accelerated beam.

5. A flat cathode ray tube as claimed in claim 2 or 3, characterized in that the first electrode of the first electron lens forms part of the means for deflecting the low energy beam in a first direction.

6. A flat cathode ray tube as claimed in claim 2 or 3, characterized in that a field-free box is provided between the first means for deflecting the beam in a first direction and the first electron lens, and the first electrode of the first electron lens forms part of the field-free box.

7. A flat cathode ray tube as claimed in claim 6 in which the means to deflect the beam in a first direction comprise a repeller electrode and a slotted electrode, characterized in that the first slotted electrode forms part of the field-free box.

8. A flat cathode ray tube as claimed in claim 2 or 3 where the first means for deflecting the beam in a first direction comprises a repeller electrode and a first slotted electrode, characterized in that between the repeller electrode and the first slotted electrode at least one intermediate slotted electrode is provided which serves to establish a uniform field between the repeller electrode and the first slotted electrode during operation of the tube.

* * * * *